US007806361B2

(12) United States Patent
Sato et al.

(10) Patent No.: US 7,806,361 B2
(45) Date of Patent: Oct. 5, 2010

(54) PAPER FEEDER AND PRINTER WITH THE SAME

(75) Inventors: Katsutoshi Sato, Shizuoka-ken (JP); Kikuo Mizutani, Shizuoka-ken (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 306 days.

(21) Appl. No.: 11/951,012

(22) Filed: Dec. 5, 2007

(65) Prior Publication Data

US 2008/0135673 A1 Jun. 12, 2008

(30) Foreign Application Priority Data

Dec. 8, 2006 (JP) ..... 2006-332182

(51) Int. Cl.
*B65H 16/02* (2006.01)

(52) U.S. Cl. ..... 242/595; 400/613

(58) Field of Classification Search ..... 242/591, 242/595; 400/613; 101/228, 232
See application file for complete search history.

(56) References Cited

U.S. PATENT DOCUMENTS

| | | | | |
|---|---|---|---|---|
| 5,174,518 | A * | 12/1992 | Hongo et al. | 242/595 |
| 5,279,472 | A * | 1/1994 | Hongo et al. | 242/595 |
| 5,820,068 | A * | 10/1998 | Hosomi et al. | 242/595 |
| 6,118,469 | A * | 9/2000 | Hosomi | 347/222 |
| 6,502,784 | B1 * | 1/2003 | Sato | 242/595 |
| 6,629,666 | B2 * | 10/2003 | Lee et al. | 242/595 |

FOREIGN PATENT DOCUMENTS

| | | |
|---|---|---|
| CA | 2001777 | 5/1990 |
| DE | 39 37 831 | 5/1990 |
| JP | S56-160107 | 12/1981 |
| JP | S58-62661 | 4/1983 |
| JP | S60-106760 | 6/1985 |
| JP | S62-198691 | 9/1987 |
| JP | S63-11825 | 1/1988 |

(Continued)

OTHER PUBLICATIONS

English translation of Notice of Reason(s) for Refusal in Japanese counterpart Application No. 2006-332182 dated Oct. 24, 2008.

(Continued)

*Primary Examiner*—William A Rivera
(74) *Attorney, Agent, or Firm*—DLA Piper LLP US

(57) ABSTRACT

Disclosed is a printer including a paper feeder for accommodating a rolled paper to be pulled out and recorded thereon. The feeder has a container section to set the roll, in which first and second support walls are arranged to rotatably support the roll. While paper from the roll is taken out, a contact force produced by the roll against the first support wall is kept larger than that in a stationary state, and a contact force produced by the roll against second support wall is kept smaller than that in the stationary state. A friction coefficient between the second support wall and the roll is larger than one between first support wall and the roll, the roll being in slidable contact with the first and second support walls. Therefore, when the recording is started, an impact force to the roll can be alleviated, resulting in reducing unevenness in image in a feeding direction of the paper.

14 Claims, 4 Drawing Sheets

FOREIGN PATENT DOCUMENTS

| | | |
|---|---|---|
| JP | H01-103645 | 4/1989 |
| JP | H01-115651 | 5/1989 |
| JP | H03-61257 | 3/1991 |
| JP | H03-162351 | 7/1991 |
| JP | 05 319637 | 12/1993 |
| JP | 07-55746 | 3/1995 |
| JP | 7-55746 | 6/1995 |
| JP | 8-9094 | 3/1996 |
| JP | 08 217294 | 8/1996 |
| JP | 8-217294 | 8/1996 |
| JP | U 3118707 | 2/2006 |

OTHER PUBLICATIONS

English language abstract of JP S63-11825, published Jan. 19, 1988.
English language abstract of JP H03-162351, published Jul. 12, 1991.
English language abstract of JP H03-61257, published Mar. 18, 1991.
English language abstract of JP H01-115651, published May 8, 1989.
English language abstract of JP H01-103645, published Apr. 20, 1989.
English language abstract of JP S56-160107, published Dec. 9, 1981.
English language abstract of JP S58-62661, published Apr. 14, 1983.
European Search Report issued Jun. 17, 2009 in corresponding EP Appl 07023780.5.
English Language Abstract of JP 08 217294, published Aug. 27, 1996.
English Language Abstract of JP 05 319637, published Dec. 3, 1993.
English Machine Translation of JP 08 217294, published Aug. 27, 19964.
English Machine Translation of JP 05 319637, published Dec. 3, 1993.
Machine English language translation of JP 8-9094, published Mar. 13, 1996.
Machine English language translation of JP 8-217294, published Aug. 27, 1996.
Machine English language translation of JP 7-55746, published Jun. 14, 1995.
Partial English translation of JP U 3118707, published Feb. 2, 2006.
Partial English translation of JP S60-106760, published Jun. 12, 1985.
English Abstract of JP-07-55746.

* cited by examiner

PAPER FEEDER AND PRINTER WITH THE SAME

BACKGROUND OF THE INVENTION (1) Field of the invention

The present invention relates to a paper feeder, and particularly to the paper feeder feeding a leading portion taken out of a rolled paper set in a container to a recording device. The present invention also relates to a printer, such as a thermal printer, equipped with the paper feeder.

(2) Description of the Related Art

A conventional paper feeder, a so-called throw-in-type paper feeder, is described in the Examined Japanese Patent Publication No. Hei 07-55746 (hereinafter referred to the JP' 746), in which, when an edge of paper taken out of a rolled paper set in a container is set to a recording section of a recording device and the paper is fed to print an image thereon, the paper can be continuously fed to the recording device while the rolled paper rotates such that it contacts front and rear walls of the container by a pulling force of the paper taken out during the rotation.

The conventional paper feeder includes a plurality of aligned support rollers rotatably provided at the bottom wall of the container to support the rolled paper such that the roll having a large diameter is supported at a rear position apart from a center of the roll by the rollers. This configuration may reduce torque of a motor to feed the paper from the roll having a large diameter, comparing with one that a roll having a large diameter is brought into contact with a bottom surface of a container without the support by rollers.

In the JP' 746 it is disclosed that friction force produced between the bottom wall of the container and the rolled paper is maintained constant, regardless of decrease in the diameter of the roll during its printing. According to the above construction, impact force is generated and applied to the paper at the recording section every time the paper is taken from the roll located in a stationary state, and thus causes deterioration of an image on the paper. However, no disclosure is present in the JP'746 as to a technology that prevents deterioration of the image on the paper caused by the impact force.

In the conventional paper feeder, the feeding speed of the paper when it is taken from the roll varies depending on an operational characteristic of the motor feeding the paper. More specifically, the motor reiterates start and stop every time the paper is fed to print thereon. Operational characteristic of the motor is composed of a slow-up period during which the number of rotations of the motor is increased gradually from a stationary state to a constant rotation, a constant rotational period during which the number of rotations is kept constant following the slow-up period, and a slow-down period during which the number of rotations is decreased gradually from the constant rotation to a stationary state. Therefore, speed of the paper fed fluctuates in response to the above-described operational characteristic.

At the slow-up period of the motor, stationary friction force produced by contacts both between the rolled paper in a stationary state and the bottom wall or the support rollers provided in the container and between the roll in the stationary state and the front wall of the container resists taking the paper from the roll. Since the paper feeder disclosed in the JP' 746 does not have any means that reduces the force for taking the paper from the roll, a stronger stationary friction force compared to a dynamic friction force acts as a relatively large feeding load against the take-out of the paper from the roll, and thus a smooth take-out of the paper from the roll can not be performed. As a result, the paper slides at the printing section instantaneously and thus it may cause unevenness in the printing pitch of images in the feeding direction.

Furthermore, after the slow-down period also, inertia attributed to rotation of the rolled paper tends to keep the rotation thereof although the motor stops. Therefore, the leading portion of the paper taken out of the roll may be apt to be taken out in excess because of the inertia.

When the paper is taken out of the roll subsequently to the above-described state in which the leading portion of the paper has been taken out in excess and has been loosed, the pulling force generated by the rotation of the motor is absorbed by the loosed portion of the paper and then makes a tension on the paper during the slow-up period of the motor. After that, the pulling force is suddenly effected to the rolled paper located in a stationary state and impact to the rolled paper is rapidly increased from the stationary state because of the rotation of the motor being increased. As a result, it becomes a high possibility that deterioration of printing is caused by unevenness in printing pitch of images in a feeding direction of the paper.

The conventional paper feeder does not include means for decreasing stationary friction force produced by a contact between the rolled paper and the front wall of the container. Therefore, when taking the paper from the roll, the stationary friction force causes an undesirable movement of the roll that the rolled paper goes up and down along the front wall for a moment. The fluctuation in position of the roll may cause the leading portion of the paper from the roll to be pulled back toward the roll, resulting in the deterioration of printing as described above.

Recently, rolled paper without a core is increasingly utilized in general to be exhausted to the end. When the roll having a small diameter resulting from the consumption receives the impact as described above, the roll may be apt to be deformed. As a result, deterioration of printing may occur in case that the rolled paper rotates intermittently in the container.

In addition, it is required in general more and more to increase the feeding speed of the rolled paper. The more the feeding speed increases, the more the impact applied to the leading portion of the rolled paper increases at the time that take-out of the paper from the roll begins. Therefore, the aforementioned problems arise remarkably.

SUMMARY OF THE INVENTION

Accordingly, it is an object of the present invention to provide a paper feeder which can alleviate an impact force produced at the beginning of take-out of rolled paper to prevent deterioration of images.

To accomplish the above-described object, a paper feeder or accommodating a rolled paper to be pulled out comprising:

a first support surface having a first friction coefficient between the first support surface and the rolled paper, the first surface and the rolled paper producing a first contact force when the rolled paper moves on the first support surface;

a second support surface having a second friction coefficient larger than the first friction coefficient between the second support surface and the rolled paper, the second support surface and the rolled paper producing a second contact force when the rolled paper moves on the second support surface; and a container section, within which the rolled paper is freely movable, composed of the first support surface and the second support surface, the first contact force produced by the rolled paper against the first support surface while paper of the roll is taken from the container section being larger than that in the stationary state of the rolled paper in the container section, the second contact force produced by the rolled paper against the second support surface while paper of the roll is taken out of the container section being smaller than that in the stationary state of the rolled paper in the container section, wherein the rolled paper in the container section is rotatably supported by the first and second support surfaces and paper taken out of the rolled paper is fed in a direction that the first contact force is strengthened.

BRIEF DESCRIPTION OF THE DRAWINGS

These and other objects and advantages of this invention will become apparent and more readily appreciated from the following detailed description of the presently preferred exemplary embodiments of the invention taken in conjunction with the accompanying drawings wherein.

DETAILED DESCRIPTION OF THE INVENTION

Figure 1:
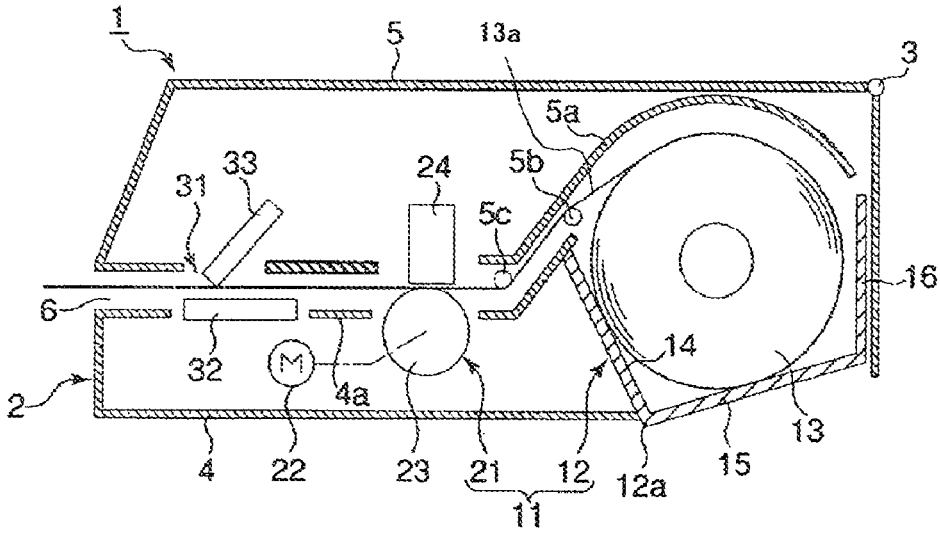
FIG. 1 is a schematic cross section illustrating a printer provided with a paper feeder according to one embodiment of the present invention.

The present invention will now be described in more detail with reference to the accompanying drawings. However, the same numerals are applied to the similar elements in the drawings, and therefore, the detailed descriptions thereof are not repeated.

A paper feeder in one embodiment of the present invention employs a container section, whose upper part is open and that rotatably supports a rolled paper set therein. A rolled paper is hereinafter referred to as "the roll." The container section is formed such that a user can set the roll into the section without any particular cares, as if the roll is simply thrown into the section. The container section includes a first wall having a first wall surface and a second wall having a second wall surface. The first wall surface is provided to support the roll in the container section such that a first contact force produced by the roll against the first wall surface while the leading portion of the roll is taken out is larger than the at in a stationary state of the roll. The second wall surface is provided to support the roll in the container section such that a second contact force produced by the roll against the second wall surface while the leading portion of the roll is taken out is smaller than that in the stationary state of the roll. A first friction coefficient between the first wall surface and the roll brought into slidable contact with the first wall surface is set to be smaller than a second friction coefficient between the second wall surface and the roll brought into slidable contact with the second wall surface.

The first and second wall surfaces may be formed in either planar-shape or curved-shape at least in a portion that the roll is brought into contact therewith. It is preferable to form the first and second wall surfaces to be oppositely tilted one the other with respect to a horizontal surface, as a V-shape in side view. In this configuration, the linkage (base portion of V-shape) between the first and second wall surfaces may be shaped in arc or in inclined surface as a smooth surface. In case that the first and second wall surfaces are curved, the first and second curved surfaces may be formed in convex shape, concave shape, or combined shape of convex and concave shapes with respect to the roll. The curved shape is preferable to satisfy the relationship between the first and second curved surfaces in which the roll does not climb up along with the first wall when paper feeding starts and then a contact force produced by the roll against the first wall surface is larger than that against the second wall surface, irrespective of change of the diameter of the roll due to the consumption of the paper.

The first and second contact forces refer to a force produced by a dead weight of the roll or a pulling force to the roll against the first and second wall surfaces respectively. A friction coefficient between the roll and the respective first and second wall surfaces brought into slidable contact with the roll includes each friction coefficient in stationary state and in kinetic state. The friction coefficient can be determined by selection of material forming the first or second wall surface. Alternatively, a friction layer having a required friction coefficient may be available for the first or second wall surface by affixing the friction layer to the first or second wall respectively. The friction coefficients and an angle formed by the first and second walls are determined, in light of size of the roll, i.e. a length in axial direction, roughness of surface of the roll, i.e. smoothness, print speed, and so on, so that a paper is stably taken out of the roll set in the container section.

In the paper feeder, the roll set in the container section can be taken out so that the paper from the roll continuously passes over the first support wall and moves toward in front of the first support wall or the paper moves upward or anterosuperior from an opposite side of the roll with respect to first support wall. Namely, any direction in which the paper from the roll is fed can be available to the extent that a contact force, which the roll presses first support wall whilst taking out the roll, is kept larger than that in a stationary state.

The paper feeder in the present invention may be applicable to a printer recording an image on a paper taken out of the roll, e.g. a thermal printer for use in issuing a receipt in a store, a barcode printer, a label printer, and a printer for a facsimile or a copy machine.

By virtue of this structure, the paper feeder can alleviate impact force produced by the start of take-out of the roll, preventing unevenness in an image.

Illustrated in FIG. 1 is a thermal printer 1 for recording an image on a receipt issued in a store. Thermal printer 1 comprises a printer housing 2, a paper feeder 11 including a container section 12 for containing the roll, a print section 21, and a cutting section 31.

Printer housing 2 is formed of a lower housing 4 and an upper housing 5 linked to lower housing 4 by a hinge 3. In printer housing 2, paper feeder 11 is incorporated at the rear side thereof and an outlet port 6 for taking out a paper is provided at the front side. Upper housing 5 can be turned around a hinge 3 as a fulcrum to open and close printer housing 2. Upper housing 5 is also utilized to allow container section 12 to open upwards so as to set or replace the roll.

In lower housing 4, a lower paper guide **4*a* is provided to direct the paper toward outlet port 6. In upper housing 5, an upper paper guide 5*a* is provided to direct the paper toward outlet port 6 in cooperation with lower paper guide 4***a*. Rear portion of upper guide 5*a* is shaped in an arc. The rear portion is positioned in upper housing 5 so that the rear portion covers the roll set in container section 12 when upper housing 5 is put on lower housing 4. A plurality of idler rollers 5*b*, 5*c* are rotatably arranged on upper paper guide 5*a* to guide a paper taken out of the roll.

Container section 12 serves as a container to be open upwards. When upper housing 5 hinged with lower housing 4 is taken off, the roll can be dropped into and set in container section 12. It is a so-called throw-in-type container. The roll is, for example, formed of a thermosensitive recording paper rolled without a core. The roll used in the present embodiment includes 80 mm in maximum diameter, 58 mm in width, and 250 g in maximum weight in the initial roll.

With reference to FIGS. 2 to 5, container section 12 includes a first support wall 14 having a first wall surface supporting the roll, a second support wall 15 having a second wall surface supporting the roll together with the first wall surface, an auxiliary wall 16, and opposite side walls not shown in the FIGURES. First support wall 14 forms a front wall of container section 12. Second support wall 15 forms a bottom wall of container section 12. Auxiliary wall 16 forms a rear wall of container section 12. The respective side walls are provided to both ends of the roll in a width direction, i.e. in a direction orthogonal to the sheet on which the figure is depicted.

In container section 12, the roll is rotatably supported to be brought into contact with both first surface of first support wall 14 and second surface of second support wall 15. In FIG. 1, rotation of the roll in counter-clock-wise allows the leading portion of the paper 13*a* taken from the roll to be fed forward, traversing the upside of first support wall 14. To achieve this, first support wall 14 is arranged to support the roll at a side of the roll, and second support wall 15 is arranged to support the roll to be taken out in association with first support wall 14. In other words, first support wall 14 is placed at a front side of the roll in a feeding direction of the paper, and second support wall 15 is placed at a rear side of first support wall 14.

First and second support walls are tilted with respect to a horizontal surface H. An angle $\gamma$ of first support wall 14 with respect to a horizontal surface H is set larger than an angle $\delta$ of second support wall 15 with respect to the surface H. Specifically, the angle $\gamma$ is preferable to range from 45 to approximately 90 degrees. The angle $\gamma$ is, for example, set to 70 degrees in this embodiment so that first support wall 14 is arranged with inclination with respect to the horizontal surface H to the front side. The sharp angle $\gamma$ can prevent the roll 13 from climbing along with first support wall 14, when the leading portion of the roll 13 is taken out. The angle $\delta$ is preferable to range less than 45 degrees, and particularly to be set at 25 degrees in this embodiment so that second support wall 15 makes the gradual slope having angle $\delta$ with respect to the horizontal surface H. Thus, as can be seen from the side of container section 12, first and second support walls 14, 15 are formed in a V-shape in cross-section. Incidentally, auxiliary wall 16 is provided to stand at the rear end of second support wall 15.

In container section 12 first and second support walls 14, 15 rotatably support the roll 13 set in the V-shape container portion having an obtuse angle. A corner (base portion of the V-shape) 12*a* at which first and second support walls 14, 15 are joined is provided to be shifted by a distance from a vertical line A passing on a center of the roll 13 toward a direction that the paper is taken out of the roll. The line A also refers to a line vertical to the horizontal surface H on which the printer is placed. A mark B in FIG. 2 denotes the shifted amount of corner 12*a* from the vertical line A. Arrangement of the shifted amount effects a larger component of weight of the roll 13 against second support wall 15 compared to a component of weight against first support wall 14 when the roll 13 is supported by first and second support walls 14, 15.

With this configuration, first and second contact points C and D on which the roll 13 is brought into slidable contact with first and second support walls 14, 15 respectively are positioned such that the first contact point C is located higher than the second contact point D. In addition, a first friction coefficient $\mu 1$, i.e. a friction coefficient between surface of first support wall 14 and the roll 13, is set to be smaller than a second friction coefficient $\mu 2$, i.e. a friction coefficient between surface of second support wall 15 and the roll 13. That is to say, $\mu 1$ and $\mu 2$ is kept to meet an inequality $\mu 2 > \mu 1$. It is preferable to set a ratio of $\mu 2/\mu 1$ in some range from 2 to 20.

To realize different friction coefficients $\mu 1$, $\mu 2$ with roll 13 on surfaces of first and second support walls 14, 15 respectively, a first material for decreasing friction resistance produced between the roll 13 and first support wall 14, and a second material for increasing friction resistance produced between the roll 13 and second support wall 15 are provided to inner surfaces of first and second support walls 14, 15 respectively. To be concrete, a tape or sheet shaped layer 17 made of the first material having an excellent smoothness, e.g. tetrafluoroethylene, is provided to the inner surface of first support wall 14 and another tape or sheet shaped layer 18 made of the second material having a low smoothness, e.g. synthetic resin, is provided to the inner surface of second support wall 15. If these layers 17, 18 are formed in tape, two sets of plurality of tapes corresponding to layers, 17, 18 may be correspondingly placed at regular intervals in a longitudinal direction of first and second support walls 14, 15, i.e., in a direction of width of the roll 13, and be affixed on first or second support walls 14, 15, respectively in a direction transverse to the longitudinal direction. In other words, longitudinal direction of the tape is orthogonal to the longitudinal direction of first and second support walls 14, 15. If these layers are formed in sheet, the sheet may be affixed on either a center portion or both ends of each support wall 14, 15 in the longitudinal direction of first and second support walls 14, 15. Incidentally a value of the smoothness or friction coefficient is determined comparing with one of the materials of first and second walls 14, 15.

As set forth above, first and second support walls 14, 15 having a predetermined angle respectively are arranged with respect to the horizontal surface H. In addition, a first acute angle $\alpha$ formed of a line E and the vertical line A is set larger than a second acute angle $\delta$ formed of a line F and the vertical line A, where the line E passes on the first contact point C and the center of the roll 13, the vertical line A passes on the center, and the line F passes on the second contact point D and the center. The relationship $\alpha > \beta$ remains regardless of change in diameter of the roll 13. In this embodiment, since first and second support walls 14, 15 are formed flat, the relationship $\alpha > \beta$ is also maintained without changing a value of angles $\alpha$ and $\beta$. Incidentally, angles $\alpha$ and $\beta$ may range from 0 to 90 degrees. Print section 21 functions to pull out the roll 13 set in container section 12 and print an image on a paper 13*a*: taken out of the roll 13. As shown in FIG. 1, print section 21 including a platen roller 23 rotated by a motor 22 and a print head 24 brought into contact with the platen roller 23 is placed at a downstream side from container section 12 in a feeding direction of the paper 13*a* from the roll 13.

A stepping motor is provided as motor 22 to drive platen roller 23 according to the number of pulses applied to the stepping motor. A take-out speed at print section 21 that paper 13*a* is taken from the roll 13 by motor 22 may be adjusted relatively high, e.g. 300 mm/sec. As can be seen in FIG. 1, motor 22 and platen roller 23 are mounted on lower housing 4. An upper circumferential surface of platen roller 23 protrudes from lower paper guide 4*a*. A thermal print head is utilized as print head 24 in the present embodiment. Print head 24 is mounted on upper housing 5 corresponding to a position of platen roller 23 and a lower edge of print head 24 protrudes downward from upper paper guide 5*a* so that paper 13*a* is firmly sandwiched between platen roller 23 and print head 24 in case that upper housing 5 is closed. In this configuration, paper 13*a* is fed by the rotation of motor 22 when image is printed on paper 13*a*.

Cutter section 31 is provided to cut the paper 13*a* at a desired length after printing. For example, in case that printer 1 is adopted in an electric cash register, paper 13*a* on which items purchased, each price and sum are printed can be cut and discharged as a receipt. Cutter section 31 includes a fixed blade 32 and a movable blade 33, e.g. a rotating blade, and is located at a further downstream from print section 21. Fixed blade 32 is attached to lower housing 4 and rotating blade 33 is attached to upper housing 5.

Setting the roll 13 in printer 1 (preparation of print) is performed by dropping the roll 13 into container section 12 while upper housing 5 is open, taking out an edge of the paper 13*a* from the roll 13 to cutter section 31 through outlet port 6, and closing upper housing 5 toward lower housing 4. This operation allows the roll 13 to be brought into rotatable contact with first and second support walls 14, 15 in container section 12. By the above closing operation, the paper 13*a* is automatically sandwiched between print head 24 and platen roller 23 in print section 21, and the leading portion of paper 13*a* is also located between fixed blade 32 and rotating blade 33 in cutter section 31.

Figure 2:
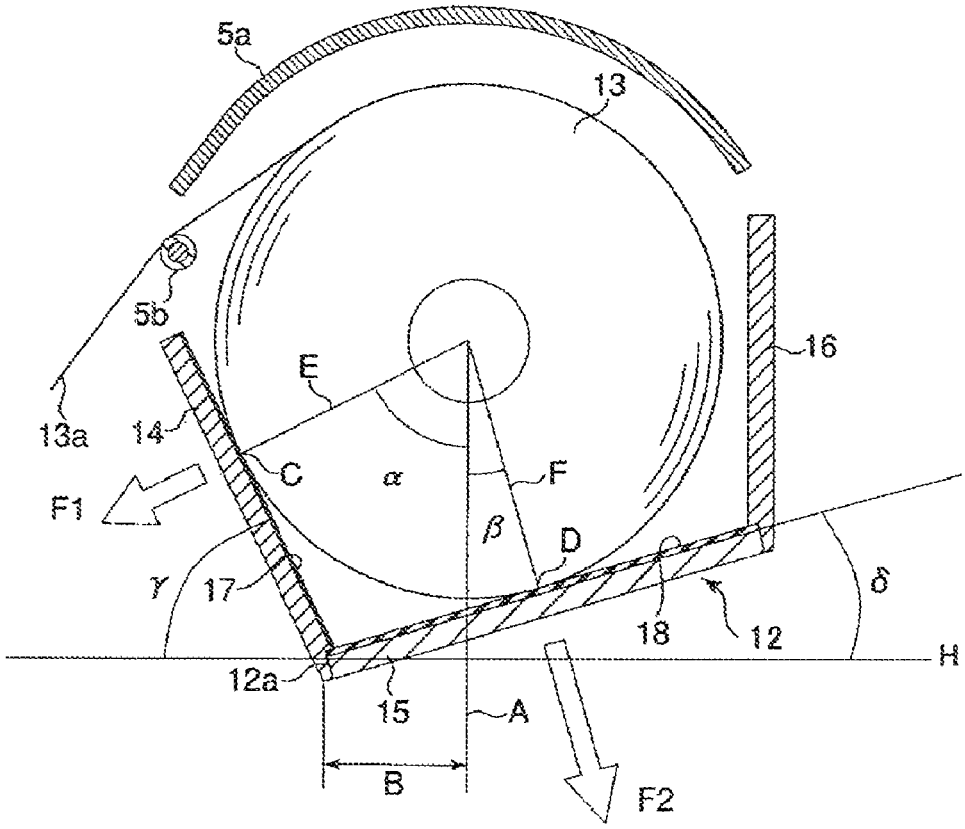
FIG. 2 is a cross section illustrating contact forces each produced by a rolled paper housed against first and second support walls of the paper feeder shown in FIG. 1 in a stand-by state of the printer.

After the completion of the above-described preparation, printer 1 maintains a stationary state, such as a standby state until power is supplied to motor 22. FIG. 2 shows, under the stationary state of printer 1, relationship between first and second contact forces F1, F2 that the roll 13 presses first and second support walls 14, 15 respectively. Since the first and second angles $\alpha$, $\beta$ satisfy an inequality $\alpha>\beta$ in container section 12 under the stationary state of printer 1, a dead weight component of the roll 13 against second support wall 15 is larger than that against first support wall 14. Therefore, the roll 13 maintains its stationary state in a state that the second contact force F2 is larger than the first contact force F1.

Figure 3:
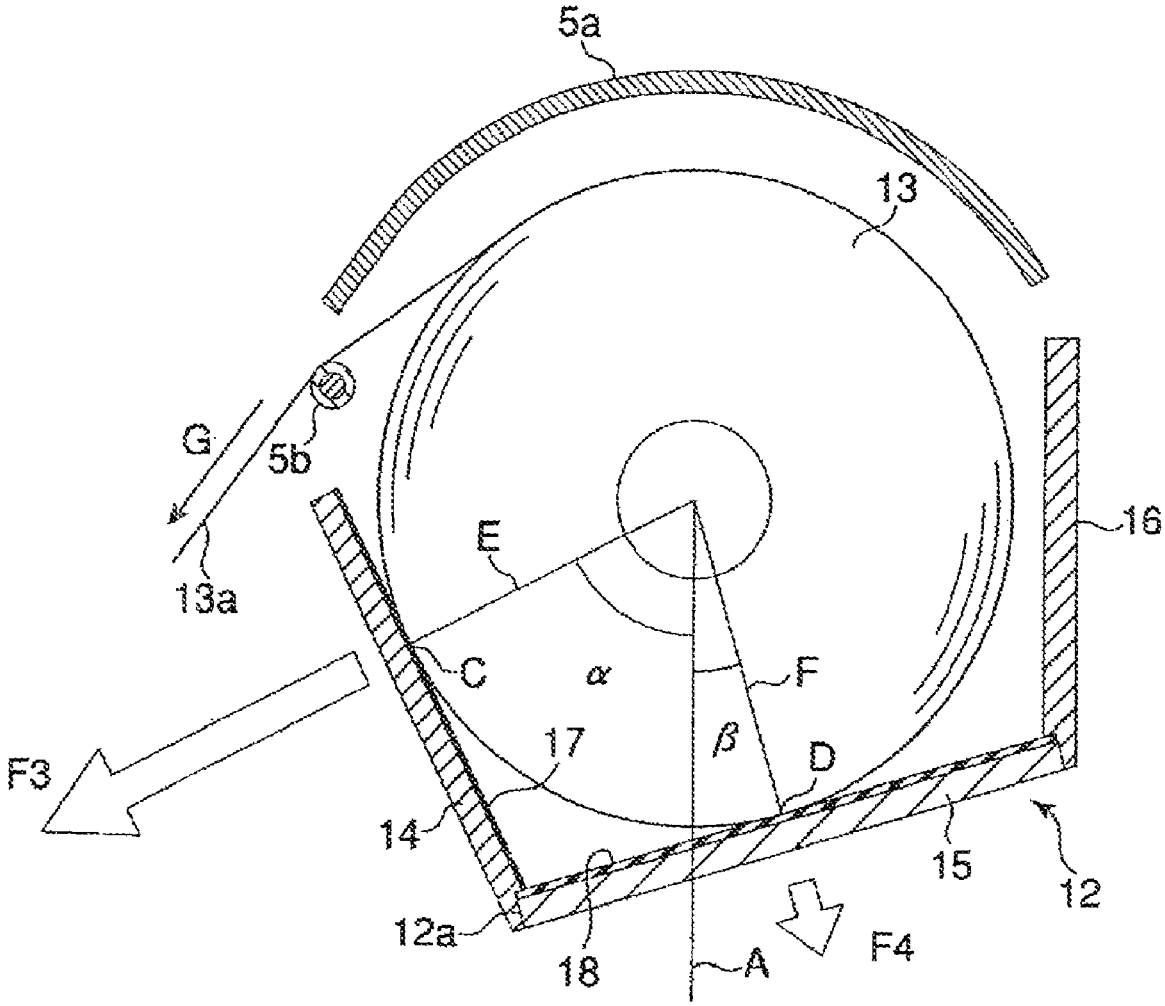
FIG. 3 is a cross section illustrating contact forces each produced by a rolled paper housed against first and second support walls of the paper feeder shown in FIG. 1 in a slow-up state of the printer.

When the print operation starts by the rotation of motor 22, platen roller 23 is rotated by motor 22 and paper 13*a* sandwiched between platen roller 23 and print head 24 is pulled by the rotation of platen roller 23 in a direction indicated by an arrow G in FIG. 3. The above-described pulling force generated by the rotation of platen roller 23 associated with print head 24 through paper 13*a* gradually increases because of the slow-up operation of the motor 22.

Immediately after the beginning of the print, since the pulling force is suddenly applied through paper 13*a* to the roll 13 that has been in the stationary state, the roll 13 momentarily tends to be lifted along with the first surface of first support wall 14. Then, in accompany with the above action of the roll 13, a contact force F3 of the roll 13 against first support wall 13 increases, i.e. F3>F1, and a contact force F4 of the roll 13 against second support wall 15 decreases, i.e. F4<F2. Therefore a friction resistance in a stationary state can be alleviated when the roll 13 begins to rotate by the pulling force applied to the roll 13 through paper 13*a*.

In other words, since friction force is in general a product of friction coefficient and a normal component of reaction, by decreasing a contact force to second support wall 15 which produces a large resistance against the rotation of the roll 13 due to its stationary friction, the resistance attributed to the stationary friction force can be reduced at the contact point D on layer 18 for increasing friction force provided to second support wall 15. On the other hand, a contact force of the roll 13 against first support wall 14 is increased because the roll 13 receives a force that makes roll 13 move forward in accompany with paper 13*a* being pulled out, and thus presses the wall 14. However, since the roll 13 is brought into contact with layer 17 for decreasing friction force provided to first support wall 14, a stationary friction force is not increased so much at the contact point C on first support wall 14.

Accordingly, since a peak value of a feeding load of the roll 13 applied to motor 22 due to pull-out of paper 13*a* from the roll 13 decreases, an impact force, generated in accompany with pull-out of paper 13*a* during the slow-up period of motor 22, which is applied to the roll 13 can be alleviated. As a result, when starting an image printing at print section 21, an irregularity in printing that unevenness in a print pitch at the beginning of printing on paper 13*a* in the feeding direction is caused by the impact force can be alleviated. Furthermore, since the peak value of the feeding load is decreased, a small sized motor having a small power can be available as motor 22.

At the time paper 13*a* is taken out of the roll 13 when printing, a phenomenon that the roll 13 is lifted momentarily along with first support wall 14 and drops down immediately thereafter is not observed. This is because that the roll 13 smoothly slides on layer 17 of first support wall 14 that is provided to decrease the friction force between the roll 13 and the wall 14. Thus, since layer 18 of second support wall 13 that is provided to increase the friction force between the roll 13 and second support wall 15 increases a braking force against the rotation of the roll 13, the feeding load momentarily increases, and thus the above-described irregularity in printing can be prevented.

Immediately after the alleviation to the impact force as described above, operation of motor 22 changes from the slow-up period to the constant rotation period, whilst the roll 13 is supported to be brought into contact with first and second support walls 14, 15 such that the pulling force applied to the roll 13 and components F3, F4 of the dead weight of the roll 13 in directions of lines E and F are balanced. In the constant rotational period, the roll 13 smoothly and slidably rotates on the surfaces of first and second support walls 14, 15 by the pulling force applied to the roll 13 through paper 13*a*. In other words, the roll 13 can be rotated in maintaining contact with the both walls 14, 15. Thus, the paper 13*a* taken out of the roll 13 can be continuously and smoothly fed to print head 24.

Figure 4:
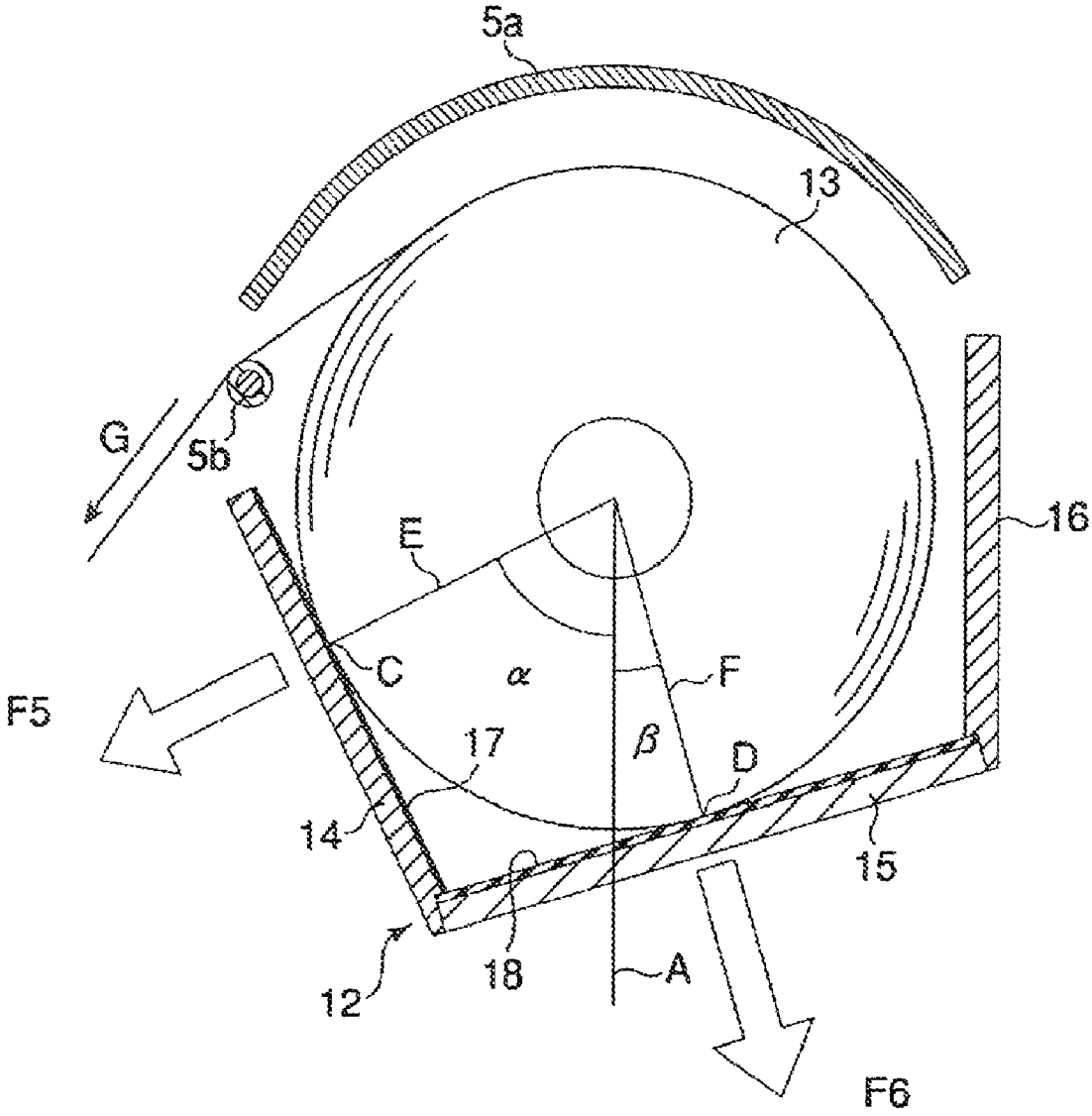
FIG. 4 is a cross section illustrating contact forces each produced by a rolled paper housed against first and second support was of the paper feeder shown in FIG. 1 while the printer operates stably.

In the constant rotation of motor 22, relationship between contact forces of the roll 13 against respective first and second support walls 14, 15 is shown in FIG. 4. As can be seen in FIG. 4, a contact force F5 at the first contact point C is smaller than a contact force F6 at the second contact point D. This configuration produces contact forces F1 through F6 to satisfy the inequalities F1<F5<F3 and F4<F6<F2. As set forth above, a resistance occurred by friction against rotation of the roll 13 is determined by a product of a contact force and a friction coefficient. The resistance defined by first support wall 14 and the roll 13 during the constant rotational period is larger Chan that in the stationary state. The resistance defined by second support wall 14 and the roll 13 during the constant rotational period is smaller than that in the stationary state.

Therefore, smooth rotation of the roll 13 brought into slidable contact with first and second support walls 14, 15 can be realized.

Next, when operation of motor 22 enters into the slow-down period by ceasing drive pulses supplied to motor 22 and thus the pulling force decreases, a force that causes the roll 13 to be in contact with first support wall 14 decreases, in the one hand, and the contact force generated by a component of dead weight of the roll 13 against second support wall 15 rapidly increases, in the other hand. Thus, a friction force is sharply increased at the second contact point D where the roll 13 is brought into contact with layer 18 for increasing friction, and rotation of the roll 13 can be dampened in a short time. Therefore, loosening of the paper 13*a* that is caused by the excessive rotation of the roll 13 with inertia thereof when take-out of the roll 13 is ended at print section 21 can be prevented.

Figure 5:
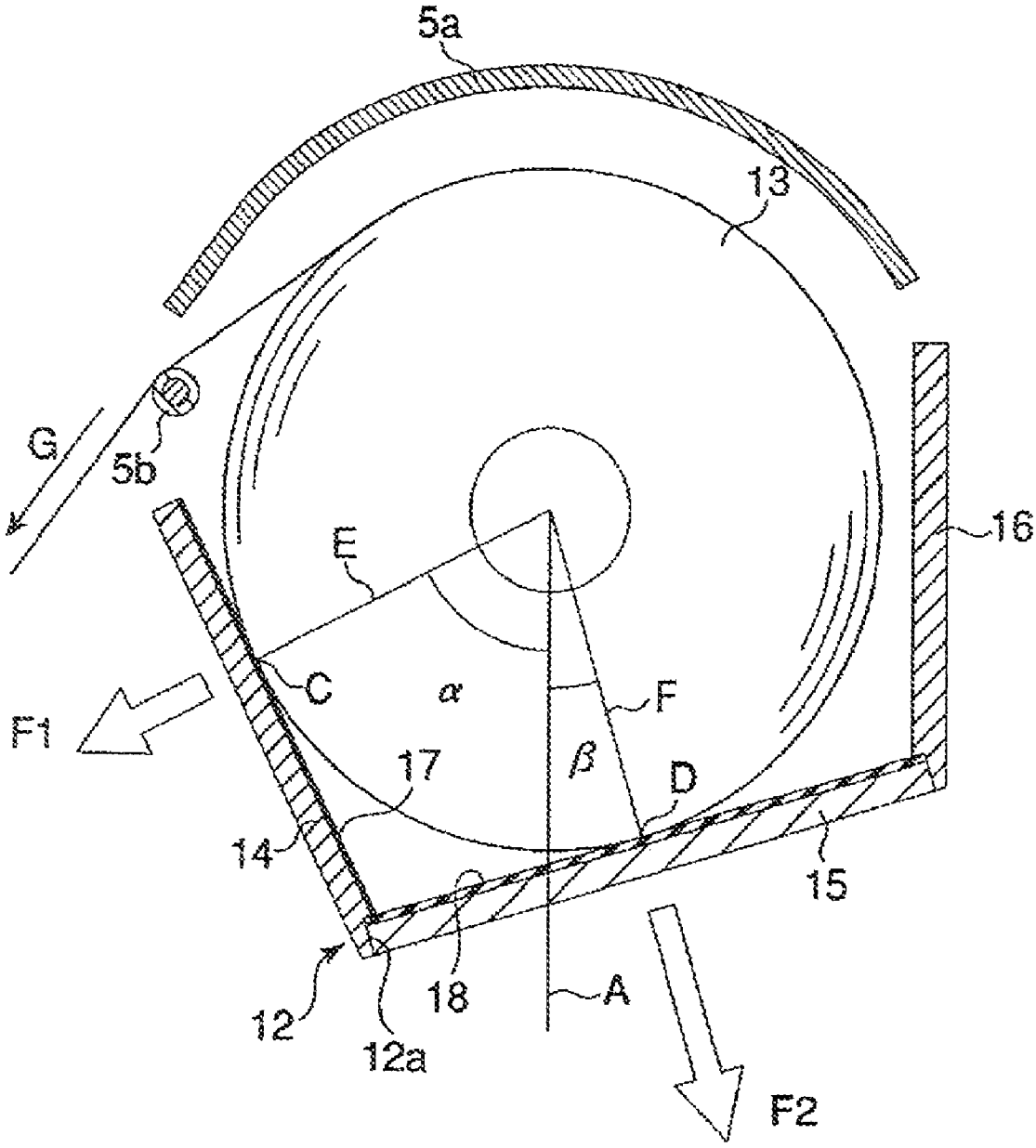
FIG. 5 is a cross section illustrating contact forces each produced by a rolled paper housed against first and second support walls of the paper feeder shown in FIG. 1 in a slow-down state or a stand-by state of the printer.

When a next printing takes place, irregularity in printing caused by the above-described large impact force can be prevented because of tensed paper 13*a*. FIG. 5 shows a cross-section of feeder after completion of the brake set forth above. After the completion of feeding paper 13*a*, printer 1 returns on standby state. Then, the relationship of two contact forces produced between the roll 13 and respective first and second support walls 14, 15 is the same as one indicated in FIG. 2.

An impact occurred when paper 13*a* is taken out of the roll 13 can be alleviated as set forth above. The alleviation can be sufficiently realized even if speed of the paper 13*a* taken out of the roll 13 is increased.

In addition, since impact against the roll 13 caused by starting take-out of paper 13*a* from the roll 13 can be alleviated, deformation from a circular shape in an initial state to an elliptical shape of the roll 13 can be prevented although the roll 13 without having a core is used in this embodiment. In case that, the roll 13 of an elliptical shape rotates, the take-out action for paper 13*a* from the roll 13 is performed intermittently resulting in irregularity in printing. However, in this embodiment, such an intermittently action can be prevented as described above and thus irregularity of printing can also be prevented. Incidentally, after the above-described printing operation is completed, paper 13*a* on which images are printed is fed by a predetermined length between print section 21 and cutter section 31, and is discharged from outlet port 6 after paper 13*a* is cut at a portion where fixed and movable blades 32, 33 locate.

Due to repetition of image printing on paper 13*a* taken out of the roll 13, diameter of the roll 13 becomes small gradually because of its consumption. The smaller the diameter of the roll 13, the shorter both distances between corner 12*a* and respective contact points C and D at which the roll 13 is brought into contact with first and second support walls 14, 15. Even if the distances are changed to be short, the angles $\alpha$ and $\beta$ can be maintained constant and the relationship between the angles $\alpha$ and $\beta$ can be maintained to satisfy the inequality $\alpha>\beta$. Besides, since the roll 13 is supported by first and second support walls 14, 15, the roll 13 is not dropped into corner 12*a* even if the diameter of the roll 13 becomes small. Therefore, regardless of changing the diameter of the roll 13, the above-described operation and effect can be maintained.

It should be noted that, when the diameter of the roll 13 became extremely small due to its consumption, the roll 13 may be occasionally fluctuated within container section 12 because the roll 13 is lifted in an approximately vertical direction through idler roller 5*b*. However, such fluctuation of the roll 13 does not affect the printing at print section 21 because of a sufficiently light weight of the roll 13.

The present invention has been described with respect to specific embodiments. However, other embodiments based on the principles of the present invention should be obvious to those of ordinary skill in the art. Such embodiments are intended to be covered by the claims.

What is claimed is:

1. A paper feeder for accommodating a rolled paper to be pulled out comprising:

a first support surface having a first friction coefficient between the first support surface and the rolled paper, the first surface and the rolled paper producing a first contact force when the rolled paper moves on the first support surface;

a second support surface having a second friction coefficient larger than the first friction coefficient between the second support surface and the rolled paper, the second support surface and the rolled paper producing a second contact force when the rolled paper moves on the second support surface; and a container section, within which the rolled paper is freely movable, composed of the first support surface and the second support surface, the first contact force produced by the rolled paper pressing against the first support surface while paper of the roll is taken from the container section being larger than that in the stationary state of the rolled paper in the container section, the second contact force produced by the rolled paper pressing against the second support surface while paper of the roll is taken out of the container section being smaller than that in the stationary state of the rolled paper in the container section, wherein the rolled paper in the container section is rotatably supported by the first and second support surfaces and paper taken out of the rolled paper is fed in a direction that the first contact force is strengthened.

2. A paper feeder according to claim 1, wherein the first and second support surfaces are disposed such that a first acute angle formed of a first phantom line to the first support surface and a vertical line is maintained larger than a second acute angle formed of a second phantom line to the second support surface and the vertical line, where the first phantom line passes on a contact point between the rolled paper and the first support surface and on a center of the rolled paper, the vertical line passes on the center of the rolled paper, and the second phantom line passes on a contact point between the rolled paper and the second support surface and on the center of the rolled paper.

3. A paper feeder according to claim 1, wherein materials of the first and second support surfaces differ from each other.

4. A paper feeder according to claim 1, wherein the first and second support surfaces are tilted with respect to a horizontal surface.

5. A paper feeder according to claim 1, wherein at least one of the first and second support surfaces is curved in shape.

6. A paper feeder according to claim 1, wherein the container section accommodates a rolled thermosensitive recording paper.

7. A paper feeder according to claim 1, wherein the container section accommodates the rolled paper that is formed without having a core.

8. A printer for recording an image on a rolled paper comprising:

a paper feeder for accommodating the rolled paper to be pulled out, including a first support surface having a first friction coefficient between the first support surface and the rolled paper, the first surface and the rolled paper producing a first contract force when the rolled paper moves on the first support surface;

a second support surface having a second friction coefficient larger than the first friction coefficient between the second support surface and the rolled paper, the second support surface and the rolled paper producing a second contact force when the rolled paper moves on the second support surface; and a container section, within which the rolled paper is freely movable, composed of the first support surface and the second support surface, the first contact force produced by the rolled paper pressing against the first support surface while paper of the roll is taken from the container section being larger than that in the stationary state of the rolled paper in the container section, the second contact force produced by the rolled paper pressing against the second support surface while paper of the roll is taken out of the container section being smaller than that in the stationary state of the rolled paper in the container section, wherein the rolled paper in the container section is rotatably supported by the first and second support surfaces and paper taken out of the rolled paper is fed in a direction that the first contact force is strengthened;

a recording head for recording the image on the paper taken out of the rolled paper;

a paper feeder cover for covering the rolled paper and opening upward; and a cutter for cutting the paper recorded by the recording head.

9. A printer according to claim 8, wherein the first and second support surfaces are disposed such that a first acute angle formed of a first phantom line to the first support surface and a vertical line is maintained larger than a second acute angle formed of a second phantom line to the second support surface and the vertical line, where the first phantom line passes on a contact point between the rolled paper and the first support surface and on a center of the rolled paper, the vertical line passes on the center of the rolled paper, and the second phantom line passes on a contact point between the rolled paper and the second support surface and on the center of the rolled paper.

10. A printer according to claim 8, wherein materials of the first and second support surfaces differ from each other.

11. A printer according to claim 8, wherein the first and second support surfaces are tilted with respect to a horizontal surface.

12. A printer according to claim 8, wherein at least one of the first and second support surfaces is curved in shape.

13. A printer according to claim 8, wherein the container section accommodates a rolled thermosensitive recording paper.

14. A printer according to claim 8, wherein the container section accommodates the rolled paper that is formed without having a core.

* * * * *